US006205622B1

(12) United States Patent
Odishoo

(10) Patent No.: US 6,205,622 B1
(45) Date of Patent: Mar. 27, 2001

(54) METHOD AND APPARATUS FOR HOLDING PAPER CURRENCY AND CREDIT CARDS

(76) Inventor: Pera M. Odishoo, 8$^{W}$ Division St. 3$^{rd}$ Floor, Chicago, IL (US) 60610

( * ) Notice: Subject to any disclaimer, the term of this patent is extended or adjusted under 35 U.S.C. 154(b) by 0 days.

(21) Appl. No.: 09/366,270

(22) Filed: Aug. 2, 1999

(51) Int. Cl.$^{7}$ ..... A45F 5/00; A44B 21/00

(52) U.S. Cl. ..... 24/17 B; 24/17 A; 59/79.1

(58) Field of Search ..... 24/17 R, 17 B, 24/17 A, 482, 483, 484, 3.1, 3.13, 301, 7; 59/79.1; 63/5.1, 3, 3.2

(56) References Cited

U.S. PATENT DOCUMENTS

| | | | | |
|---|---|---|---|---|
| 463,380 | * | 11/1891 | Dixon et al. | 24/17 B X |
| 1,006,584 | * | 10/1911 | Millsaps | 24/17 A |
| 1,037,086 | * | 8/1912 | Tusten | 59/79.1 X |
| 1,960,690 | * | 5/1934 | Blair | 24/17 B |
| 2,689,450 | | 9/1954 | Stiegele . | |
| 2,790,302 | * | 4/1957 | Minematsu | 59/79.1 |
| 2,799,135 | | 7/1957 | Dolansky . | |
| 2,941,351 | | 6/1960 | Dolansky . | |
| 3,119,249 | * | 1/1964 | Goldstein | 59/79.1 |
| 3,307,347 | | 3/1967 | Christoff . | |
| 3,307,348 | | 3/1967 | Vanover . | |
| 3,416,305 | | 12/1968 | Rieth . | |
| 3,587,226 | | 6/1971 | Rieth . | |
| 3,625,001 | | 12/1971 | Levinger . | |
| 3,786,629 | | 1/1974 | Rieth . | |
| 3,798,729 | * | 3/1974 | Tanaka | 63/1.5 X |
| 3,994,126 | * | 11/1976 | Rieth | 59/79.1 |
| 4,096,688 | | 6/1978 | Rieth . | |
| 4,723,406 | | 2/1988 | Ripley . | |
| 5,279,019 | | 1/1994 | Knickle . | |
| 5,367,752 | * | 11/1994 | Petty | 24/17 B X |

FOREIGN PATENT DOCUMENTS

| | | | | |
|---|---|---|---|---|
| 1684 | * | 7/1859 | (GB) | 24/17 B |

* cited by examiner

*Primary Examiner*—Robert J. Sandy
(74) *Attorney, Agent, or Firm*—Knechtel, Demeur & Samlan

(57) ABSTRACT

A method for holding money and money clip or band designed to efficiently accommodate and hold all amounts and quantities of paper currency. The money clip uses a continuous row of outer members and a continuous row of inner members that are interconnected through a linkage system that provides for the longitudinal displacement of the outer members and inner members relative to one another to receive and hold the paper currency inserted. The band is very sturdy and flexible to provide for reversibility in that it may be rotated 180 degrees so that either side may be used as the exposed outer display surface. The exposed outer display surface is presented with an attractive display.

21 Claims, 2 Drawing Sheets

METHOD AND APPARATUS FOR HOLDING PAPER CURRENCY AND CREDIT CARDS

I. FIELD OF THE INVENTION

The present invention relates to money clips and, more particularly, to an expansion band that provides two rows of continuous members that are interlinked to provide longitudinal displacement of the links relative to one another to receive and hold various amounts of money, such as paper currency and credit cards.

II. DESCRIPTION OF THE PRIOR ART

In the past two adjacent rows of interlinked members have been used as a bracelet for watches to permit the bracelet to expand to receive a person's hand and then contract to surround the person's wrist to support the watch.

Various types of linkage designs have been used in expandible bracelets for watches and are disclosed in U.S. Pat. No. 4,723,406 to Ripley entitled "Expansible Linkage For Use In Making a Watchband or Similar Article"; U.S. Pat. No. 4,096,688 to Rieth entitled "Expansible Linkage For Wrist Watch Bracelets, Identification Bracelets and The Like"; U.S. Pat. No. 3,786,629 to Rieth entitled "Expansible Linkage For Use In Making a Watchband or Similar Article"; U.S. Pat. No. 3,625,001 to Levinger entitled "Link For Use In Making a Linkage For a Watch Bracelet or Similar Article and Expansible Linkage Made Therefrom"; U.S. Pat. No. 3,587,226 to Rieth entitled "Expansible Linkage For Use In Making a Watch Band or Similar Article of Jewelry"; U.S. Pat. No. 3,416,305 to Rieth entitled "Adjustable Section For a Watch Bracelet"; U.S. Pat. No. 3,307,348 to Vanover entitled "Expansible Linkage For Use In Making a Watch Band or Similar Article of Jewelry"; U.S. Pat. No. 3,307,347 to Christoff entitled "Expansible Band"; U.S. Pat. No. 2,941,351 to Dolansky entitled "Elastic Bands Having Pivotally Connected Links and Clearance Openings For the Biasing Spring"; U.S. Pat. No. 2,799,135 to Dolansky entitled "Expansible Bracelet With Recessed Connecting Links"; and U.S. Pat. No. 2,689,450 to Stiegele entitled "Expansible Bracelet."

Applicant referes to the linkage design of the bracelet as disclosed in the U.S. patents listed in the above paragraph. Although Applicant's invention uses a linkage design like those disclosed in the issued patents, the prior art does not teach or suggest that such a linkage design is useful as a money holder.

Money clips have long been used to hold paper currency or credit cards in an organized fashion. The typical money clip consists of a single piece of metal bent or folded at its midpoint. The ends folded about the midpoint are placed flush against one another to form a gap between the folded ends and the midpoint. The currency or credit cards are inserted between the folded ends into the gap and held in place through the pinching of the folded ends on the currency or credit cards. A shortcoming of this money clip is that this money clip defines the thickness of the gap at its folded midpoint and, therefore, this money clip limits the sizes and thicknesses of money that may be held by the money clip. Furthermore, if the ends of the money clip are spread apart too far, the money clip is permanently deformed making it unusable to hold smaller sizes and thicknesses of money. Another shortcoming is that this money clip is susceptible to breaking at its midpoint if the folded ends are displaced far enough from one another. Another shortcoming is that a portion of the money remains exposed and not completely secured within the money clip and, therefore, the money is vulnerable to undesired removal from the money clip.

The shortcoming of the previous money clip that relates to the undesired removal of money due to the money clip not completely securing the money was solved in U.S. Pat. No. 5,279,019 to Knickle entitled "Credit Card And Money Carrying Device" which discloses a carrying device that uses a band of elastic material that is flexible and permits expansion to completely secure money within the band. The elastic material is formed into a band when the free ends of the band are fastened together. The ends of the band are held in place and protected by a metal cover plate that is crimped around the band where the ends are attached. A shortcoming of this carrying device is that the band has a weakness where the free ends of the band are fastened. As a consequence, the band is susceptible to easy breaking after continued use or wear and tear. Another shortcoming of this device is that the cover is required to protect the band where the free ends are fastened together. Another shortcoming is that the length of the cover limits the thickness of how much money may be held by the carrying device. Furthermore, the band may not slide easily into the user's pocket due to friction between the band and the cloth pocket.

Thus, there is a need and there has never been disclosed an expansion band that uses an interlinking system of members for use as a money clip to correspondingly expand to the size and thickness of the money inserted into the band to efficiently hold the money.

III. OBJECTS OF THE INVENTION

It is the primary object of the present invention to provide a linkage system that is designed for use as a money clip. A related object of the present invention is to provide a money clip that is expandable to hold all variations and quantities of paper currency.

Another object of the present invention is to provide a money clip that is designed to be carried in a pants pocket, jacket pocket, or in any other manner suitable by the user. A related object of the present invention is that the money clip is designed with a surface that is amenable to contact with the lining of a pants pocket, jacket pocket, or in any other manner suitable by the user.

Still another related object of the present invention is to provide a money clip that is easy and convenient to use. Another object is to provide a flexible money clip that is reversible so that either side can act as the exposed side.

Yet another object is to provide an expansion money clip that can accommodate a solid extended length link on which may be placed an engraved design or decorative gems.

Other objects of the present invention will become more apparent to persons having ordinary skill in the art to which the present invention pertains from the following description taken in conjunction with the accompanying drawings.

IV. SUMMARY OF THE INVENTION

The present invention is a device that uses a continuous band with a linkage system to securely hold all sizes and amounts of money in an organized and efficient manner. The band consists of two rows of members interconnected through the use of links to form a continuous expandable loop.

The two rows of members are separated into an outer row and an inner row. Each member of the outer row is connected through two links to two corresponding members on the inner row. Likewise, each member of the inner row is connected through two links to two corresponding members on the outer row. The links permit the members of the outer row and the members of the inner row to expand in a longitudinal direction away from its adjacent member to receive and hold the inserted money. The links also allow the continuous band to be turned around so that either of the two rows of members can become the exposed surface. Thus, the continuous band is reversible.

V. BRIEF DESCRIPTION OF THE DRAWINGS

The Description of the Preferred Embodiment will be better understood with reference to the following figures.

VI. DETAILED DESCRIPTION OF THE PREFERRED EMBODIMENT

Figure 1:
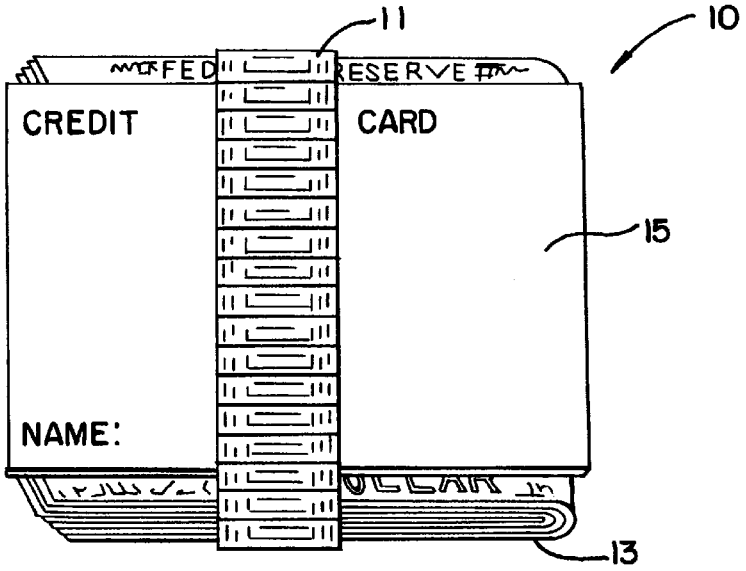
FIG. 1 is a perspective view of applicant's band holding paper currency and a credit card.

Turning first to FIG. 1, there is illustrated a money clip holder 10 and, in particular, a band 11 that is holding money for the user in the form of a credit card 13 and paper currency 15. Preferably, the money inserted into band 11 includes but is not limited to paper currency, checks, and credit cards. Band 11 may be made of copper, silver, gold, platinum, or of any metal or alloy. Band 11 is a continuous band, with no beginning or end.

Figure 2:
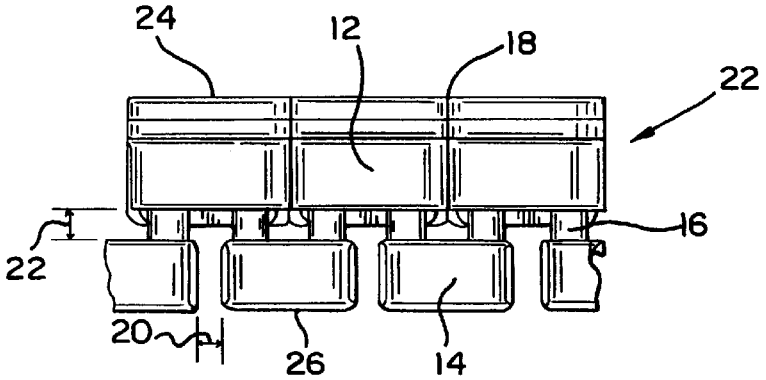
FIG. 2 is a side view, with portions removed, of a section of a prior art bracelet illustrating the members of the inner and outer rows interlinked together in a closed flat configuration.

Turning to FIG. 2, there is illustrated a section of a prior art band 11 with outer members 12 and inner members 14 in a closed flat configuration. The number of outer members 12 and inner members 14 to complete band 11 is variable and depends upon the size and amount of money to be inserted. In the preferred embodiment, the number of outer members 12 should be equal to the number of inner members 14.

Outer members 12 are connected to inner members 14 through links 16. Outer members 12 and inner members 14 are situated on opposite sides of links 16. In the closed flat configuration, outer members 12 abut adjacent outer members 12 at flush point 18. Inner members 14 are also adjacent to other inner members 14, but are situated a separation distance 20 from the closest inner member 14. In a closed circle configuration, outer members 12 continue to abut adjacent outer members 12 at flush point 18. For inner members 14, separation distance 20 becomes smaller or removed all together as inner members 14 are pushed toward other inner members 14.

Each outer member 12 has two links 16 extending perpendicular from outer member 12 toward inner members 14. Each link 16 extending from outer member 12 corresponds to a separate inner member 14. Likewise, each inner member 14 has two links 16 connected to separate corresponding outer members 12. Typically, outer members 12 and inner members 14 remain parallel to each other and are separated by a link distance 22. Furthermore, the interconnections between the outer members 12 and inner members 14 is designed so that adjacent outer members 12 and adjacent inner members 14 can be pivoted or angularly displaced relative to one another. This allows band 11 to rotate 180° without the need for any of the members or links to be disassembled or disconnected.

Outer members 12 are illustrated in FIG. 2 to have a top surface 24. In the preferred embodiment, top surface 24 may be flat or have small embedded designs provided top surface 24 remains smooth to the touch. Top surface 24 is the part of band 11 that is primarily touched by the user, is placed in contact with the lining of a pants pocket, jacket pocket, or shirt pocket, and which in many instances is felt through the lining on the body of the user. A smooth top surface 24 provides a band 11 that is comfortable for the user in whatever locations band 11 is placed. It also provides an exposed outer display surface which is pleasing in its appearance.

Inner members 14 are illustrated in FIG. 2 to have an inner surface 26. Typically, inner surface 26 is flat. In the preferred embodiment, inner surface 26 is flat and smooth to the touch to accommodate the money that is inserted within band 11. If inner surface 26 is not smooth, inner surface 26 can catch or snag the paper currency inserted into band 11 and, consequently, tear the paper currency.

Figure 3:
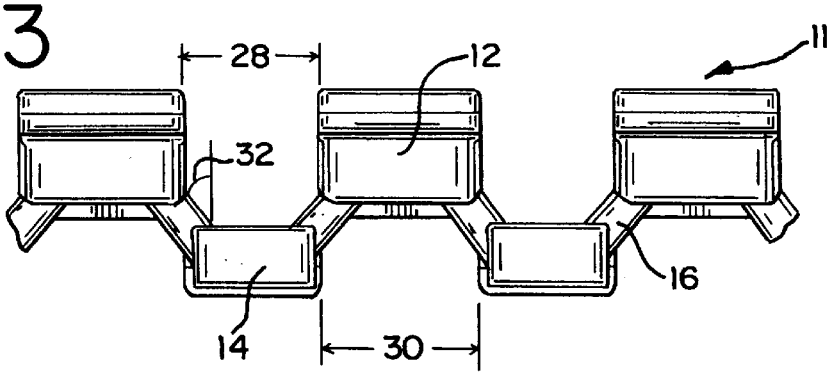
FIG. 3 is a side view, with portions removed, of a section of a prior art bracelet illustrating the members of the inner and outer rows as interlinked together in an expanded flat configuration.

In FIG. 3, there is illustrated a section of a prior art band 11 with outer members 12 and inner members 14 in an expanded flat configuration. In the expanded configuration, outer members 12 become separated by an expanded outer distance 28 and inner members 14 become separated by an expanded inner distance 30. Upon the separation of outer members 12 and inner members 14, links 16 are rotated through a link angle 32. Preferably, the maximum link angle 32 is approximately 45°. Alternatively, link angle 32 may be larger to permit a further expansion of band 11.

The details of various linkage designs as to the connection of links 16 to both outer members 12 and inner members 14 and the how links 16 permit outer members 12 and inner members 14 to expand is disclosed in the U.S. patents listed above. In the preferred embodiment, band 11 may be any band 11 as discussed in FIGS. 1 and 2 and that uses any linkage design as disclosed in the U.S. patents incorporated by reference.

Figure 4:
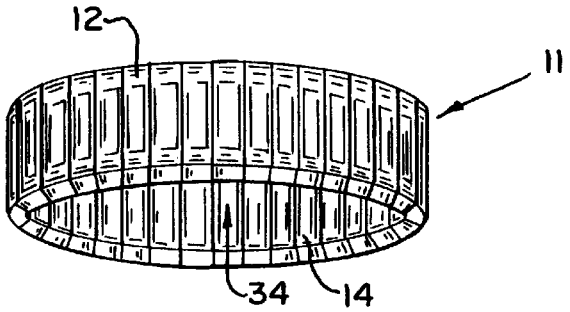
FIG. 4 is a perspective view of a money clip band with the outer and inner members in a continuous uninterrupted loop.
Figure 5:
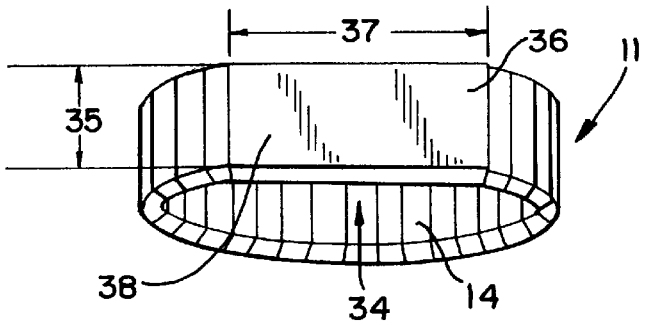
FIG. 5 is a perspective view of a money clip band with the outer and inner members in a continuous loop separated by an extended length link.
Figure 6:
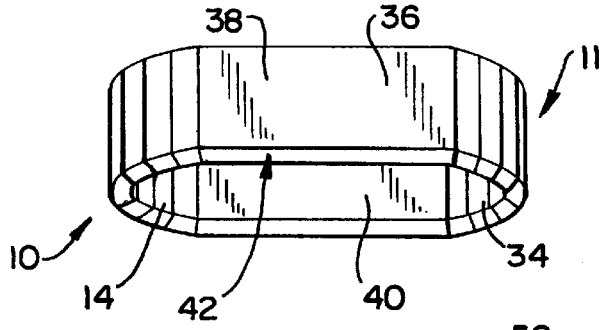
FIG. 6 is a perspective view of a money clip band with the outer and inner members in a continuous loop separated by two opposed solid extended length links.

FIGS. 4–6 are alternate embodiments of band 11. In each figure, band 11 forms a continuous loop 34. The interior of loop 34 defines where the money is inserted and securely held by band 11 as illustrated in FIG. 1. In FIG. 4, outer members 12 and inner members 14 combine to form a complete, continuous band 11.

In FIG. 5, outer members 12 and inner members 14 of band 11 are connected by an extended length link 36 which is configured as a substantially flat plate. Extended length link 36 has a link width 35 and a link length 37. Preferably, link width 35 has the same width as band 11 and link length 37 extends in the same direction as the circumference of band 11. In the preferred embodiment, extended length link 36 has a link top surface 38 that is flat and smooth to accommodate contact with the lining of a pants pocket, jacket pocket, or shirts pocket, and, in many instances, the body of the user as felt through the lining. It is contemplated that link top surface 38 may be engraved or encrusted with gems.

In FIG. 6, band 11 has extended length link 36 and extended length link 40. Preferably, extended length link 40 is identical to extended length link 36 and situated in a position along band 11 that is directly opposite to the position of extended length link 36. The positioning of extended length links 36 and 40 opposite one another permits easier use of the money clip 10, easier insertion of the money into band 11, and a convenient and proper securing of the money while held by band 11. Extended length links 36 and 40 have a link bottom surface 42. In the preferred embodiment, link bottom surface 42 is flat and smooth to the touch to receive the money that is inserted into the band 11.

Figure 7:
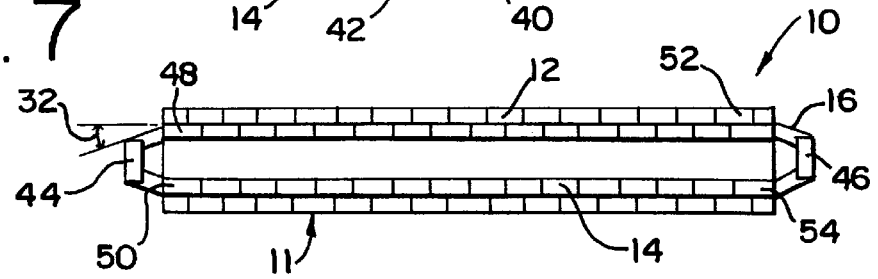
FIG. 7 is a side view of the money clip of FIG. 1, with the money removed, slightly expanded to hold a small amount of money.

In FIG. 7, band 11 of money clip 10 is slightly expanded to hold a small amount or number of bills. For small amounts or numbers of bills, outer members 12 will pivot to accommodate the size and/or quantity of the money. This is represented in FIG. 7 by outer members 12 being longitudinally displaced in the same direction as the circumference of band 11 and assuming expanded positions 44 and 46. To permit the expansion of outer members 12 to expanded positions 44 and 46, links 16 are rotated through link angle 32 as permitted by inner members 14 and as represented by inner members 14 located at positions 48, 50, 52, and 54.

Figure 8:
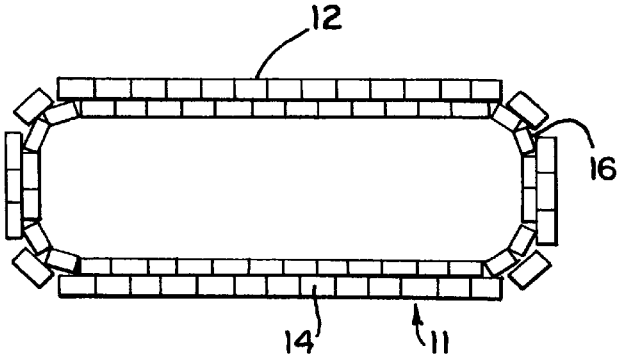
FIG. 8 is a side elevational view, similar to FIG. 7, of a money clip greatly expanded to hold a large quantity of money.

To accommodate much larger sizes and quantities of money, additional outer members 12 and inner members 14 are longitudinally displaced to provide an expansion as illustrated in FIG. 8. In this configuration, several outer members 12 are positioned at either end of band 11 to accommodate the added amounts of money or numerous credit cards. However, inner members 14 still remain flat and in a fairly constant horizontal plane along the length of band 11. Alternatively, if the user desires to roll a large amount of paper currency into a cylinder instead of folding it over onto itself, band 11 can expand and receive the rolled paper currency in loop 34.

Outer members 12 and inner members 14 are further connected by internal springs that control the force necessary to expand the members relative to each other. The force is minimal so that when only a few dollars are inserted in loop 34 (FIGS. 4–6), the force of the springs causes outer members 12 and inner members 14 to contract and will not cause the currency to buckle or fold over onto itself Thus, as few as one dollar may be held by band 11 without causing the dollar to crease or buckle. On the other hand, as many as thousands of dollars may also be received in loop 34 by expansion of outer members 12 and inner members 14 relative to each other.

Figure 9:
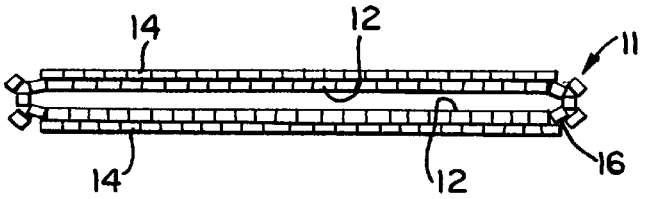
FIG. 9 is a side elevational view, similar to FIG. 8, except that the band of the money clip has been reversed.
Figure 1:
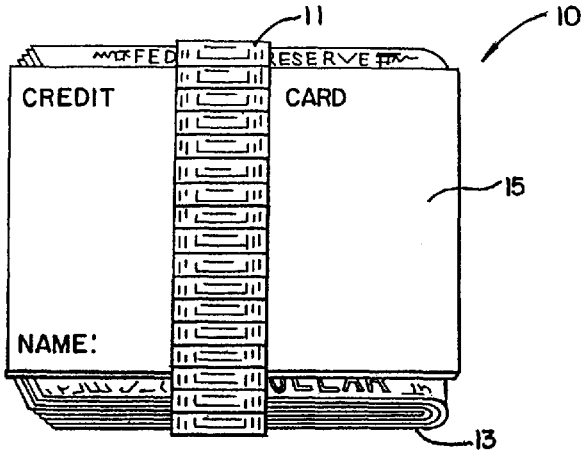
Figure 2:
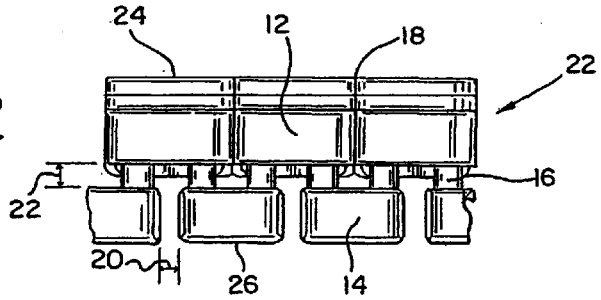
FIG. 2 PRIOR ART
Figure 3:
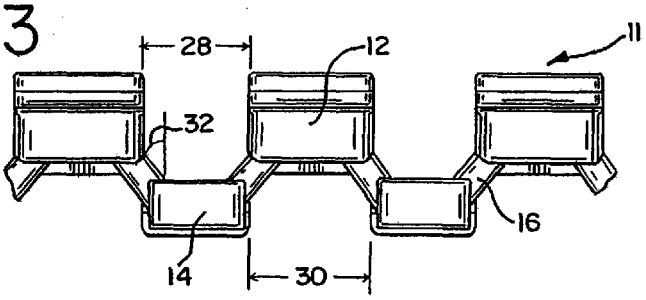
FIG. 3 PRIOR ART
Figure 4:
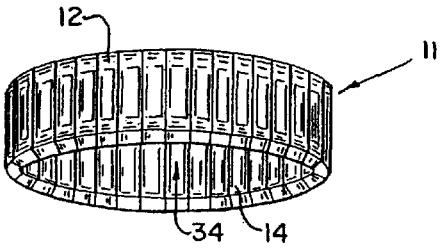
Figure 5:
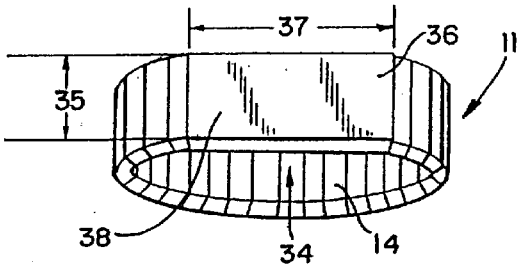
Figure 6:
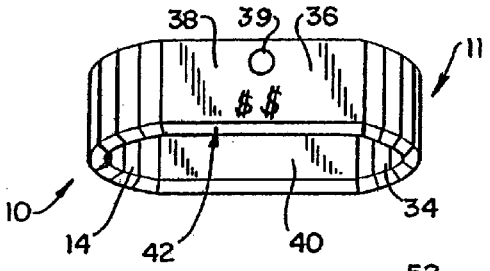
Figure 7:
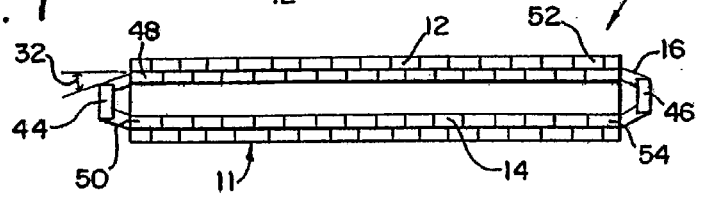
Figure 8:
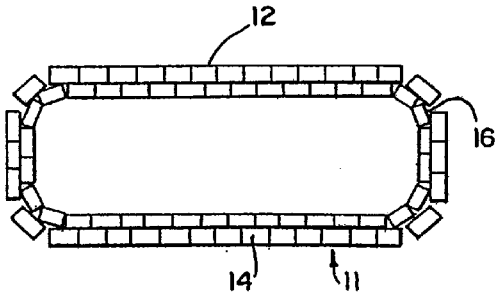
Figure 9:
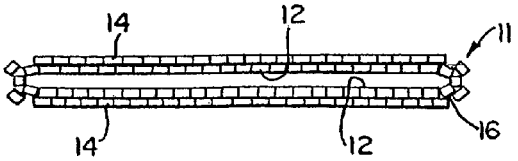

The manner in which outer members 12 and inner members 14 are connected provides a very sturdy yet flexible band 11. In fact, the linkage arrangement is so flexible that band 11 can be rotated about itself such that outer members 12 and inner members 14 are actually rotated 180 degrees. Band 11 can then assume the configuration as illustrated in FIG. 9. Outer members 12 assume the position previously held by inner members 14; likewise inner members 14 assume the position previously held by outer members 12.

This reversible feature of the band gives an added advantage to the invention. By reversing the orientation of the band, the user gets to display either outer members 12 or inner members 14 as an exposed outer display surface. Thus, outer members 12 and inner members 14 can be provided with different materials or appearance and the user can select which members he wishes to use as the exposed outer display surface. For example, outer members 12 may be silver and inner members 14 may be gold. The user has the option to display either the silver or gold as the exposed outer surface. Similarly, if extended length link 36 is used in band 11, one side of extended length link 36 may be engraved while the other side may have gemstones embedded therein.

Thus, there has been provided a money clip that uses a band of outer members and inner members interconnected through the use of a linkage design to expand and contract in order to permit the efficient and convenient holding of money. While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope of the appended claims.

What is claimed is:

1. A method of securely holding paper currency or credit cards the paper currency or the credit cards having at least two opposite edges, comprising the steps of:

providing a continuous expandable metal band with a decorative display surface comprised of a plurality of interconnected adjacent metal links which are capable of longitudinal movement with respect to each other;

providing an outer surface and a reversible inner surface on the adjacent metal links, selecting whether the outer surface of the adjacent metal links or the reversible inner surface of the adjacent metal links is to be the display surface, rotating the adjacent metal links 180° as necessary to orient the metal links with the outer surface or the reversible inner surface as the display surface, applying a force for longitudinally displacing the adjacent metal links thereby expanding the band radially outward;

releasing the force for contracting the displaced links around the paper currency or the credit cards to be held; and encircling the at least two opposite edges of the paper currency or the credit cards with the expandable band for securely holding the paper currency or the credit cards.

2. The method of claim 1 and further comprising the step of providing a plurality of adjacent outer members with the outer surface and providing a second row of adjacent inner members which is parallel to and inside of the adjacent outer members, the inner members having the reversible inner surface, the adjacent outer members and adjacent inner members connected by metal connecting links.

3. The method of claim 2 and further comprising the step of selecting whether the outer members or the inner members are to be oriented as the outer display surface and rotating the outer members and the inner members 180° as necessary to orient the selected outer members or the selected inner members as the outer display surface.

4. The method of claim 1 and further comprising the step of providing spring loaded interconnecting means for allowing the longitudinal displacement of the interconnected adjacent metal links from each other.

5. The method of claim 1 and further comprising the step of providing at least one extended length link which is longer than the adjacent metal links and is adapted to receive decorative indicia thereon.

6. The method of claim 1 and further comprising the step of providing at least one extended length link interconnected to and separating the adjacent metal links.

7. The method of claim 6 and further comprising the step of providing a solid flat, smooth top surface on the extended link.

8. The method of claim 6 and further comprising the step of providing engraving on the extended length link.

9. The method of claim 6 and further comprising the step of providing a gem stone on the extended length link.

10. A method of securely holding paper currency or credit cards, the paper or the credit cards having at least two opposite edges comprising the steps of:

providing an expandable metal band with an exposed decorative display surface comprised of a plurality of a first row of adjacent metal outer members with an outer display surface;

providing a second row of adjacent metal inner members which is parallel to and inside of the outer members, the inner members having a reversible inner display surface;

interconnecting the outer members to the inner members for allowing longitudinal displacement of the outer members and the inner members from adjacent outer and inner members respectively;

selecting whether the outer display surface of the outer members or the reversible inner display surface of the inner members is to be oriented as the exposed display surface and rotating the outer members or the inner members 180° as necessary to orient the selected outer members with the outer display surface or the selected inner members having the reversible inner display surface as the exposed display surface, applying a force for longitudinally displacing the adjacent outer members from each other and the adjacent inner members from each other thereby expanding the band radially outward;

releasing the force for contracting the displaced outer members and the displaced inner members around the paper currency or the credit cards to be held; and encircling the at least two opposite edges of the paper currency or the credit cards with the expandable band for securely holding the paper currency or the credit cards.

11. An expandable band for use as a money clip to hold paper currency or credit cards, comprising:

a first row of adjacent metal outer members;

a second row of adjacent metal inner members interconnected with the first row of outer members;

a plurality of links for interconnecting the outer members and inner members to each other, each outer member being interconnected by at least two links to at least two inner members and each inner member is interconnected by at least two links to at least two outer members;

a flat, reversible extended length link separating the first row of outer members and the inner members, the extended length link having a top surface and a bottom surface where either of the surfaces may be selectively displayed;

the outer members and inner members capable of longitudinal displacement relative to one another through the interconnection of the outer members to the inner members with the expandable band adapted for encircling at least two edges of the paper currency.

12. The money clip of claim 11 wherein the outer members and the inner members are separated by at least two extended length links.

13. The money clip of claim 12 wherein the link top surface is flat and smooth.

14. The money clip of claim 12 wherein the link top surface is engraved.

15. The money clip of claim 12 wherein the link top surface is encrusted with gems.

16. The money clip of claim 12 wherein the link bottom surface is flat and smooth.

17. The money clip of claim 11 wherein each outer member has a top surface, the top surface being flat and smooth.

18. A method of securely holding paper currency or credit cards the paper currency or the credit cards having at least two opposite edges, comprising the steps of:

providing a continuous expandable metal band with a decorative display surface comprised of a plurality of interconnected adjacent metal links which are capable of longitudinal movement with respect to each other;

connecting at least one extended length link having a display surface to the adjacent metal links;

applying a force for longitudinally displacing the adjacent metal links thereby expanding the band radially outward;

releasing the force for contracting the displaced links around the paper currency or the credit cards to be held; and encircling the at least two opposite edges of the paper currency or the credit cards with the expandable band for securely holding the paper currency or the credit cards.

19. The method of claim 18 and further comprising the step of providing at least two extended length links having display surfaces thereon.

20. The method of claim 18 and further comprising the step of providing a flat extended length link.

21. The method of claim 18 and further comprising the step of providing an outer surface and a reversible inner surface on the adjacent metal links, selecting whether the outer surface of the adjacent metal links or the reversible inner surface of the adjacent metal links is to be the display surface, rotating the adjacent metal links 180° as necessary to orient the metal links with the outer surface or the reversible inner surface as the display surface.

* * * * *

UNITED STATES PATENT AND TRADEMARK OFFICE

CERTIFICATE OF CORRECTION

PATENT NO. : 6,205,622 B1
DATED : March 27, 2001
INVENTOR(S) : Odishoo, Pera M.

It is certified that error appears in the above-identified patent and that said Letters Patent is hereby corrected as shown below:

Drawings,
Sheet 1,
Figure 2, added -- Prior Art -- to figure, as shown on attached drawing
Figure 3, added -- Prior Art -- to figure, as shown on attached drawing Sheet 2,
Figure 6, added gemstone 39 and appropriate leader line to figure, as shown on attached drawing
Figure 6, added engraving -- $ $ -- to figure, as shown on attached drawing Signed and Sealed this Twenty-fifth Day of February, 2003

JAMES E. ROGAN
*Director of the United States Patent and Trademark Office*